United States Patent [19]

Benzel, Jr.

[11] 4,300,793

[45] Nov. 17, 1981

[54] HEAVY DUTY SECURITY LOCK

[76] Inventor: Alfred W. Benzel, Jr., 12409 Holsclaw Hill Rd., Brooks, Ky. 40109

[21] Appl. No.: 140,194

[22] Filed: Apr. 14, 1980

[51] Int. Cl.[3] ..... E05C 3/04

[52] U.S. Cl. ..... 292/205; 292/DIG. 46; 292/281

[58] Field of Search ..... 292/205, 281, 282, 302, 292/DIG. 46; 70/81, 82, 99, 100, DIG. 12; 49/449, 394

[56] References Cited

U.S. PATENT DOCUMENTS

| | | | |
|---|---|---|---|
| 277,879 | 5/1883 | Burkhardt | 292/205 |
| 878,047 | 2/1908 | Darracott | 292/205 |
| 1,049,381 | 1/1913 | Martineau | 292/282 |
| 1,195,493 | 8/1916 | Nedrow | 292/281 |
| 1,197,585 | 9/1916 | Archibald | 292/205 X |
| 1,508,091 | 9/1924 | Diesel | 292/281 |
| 3,094,861 | 6/1963 | Sayles | 292/DIG. 46 |
| 3,759,557 | 9/1973 | Athas | 292/281 |
| 3,852,981 | 12/1974 | Koning | 292/205 X |

*Primary Examiner*—Roy D. Frazier

*Assistant Examiner*—Peter A. Aschenbrenner

*Attorney, Agent, or Firm*—Richard L. Caslin

[57] ABSTRACT

A heavy duty security lock is shown that is easy to install to an existing movable closure for holding the closure in a closed position relative to a fixed enclosure. An important feature is the ease of mounting this security lock between the door and the door jamb. In order to prepare the door for receiving this lock, it should have a through hole near the vertical free edge of the door similar to the through hole for receiving a standard cylinder lock on the order of about two and one-eighth inches in diameter. The present invention incorporates a base plate having a perpendicular locking tongue fitted with a shortened collar that is mounted within the through hole in the door. An adjustable locking means engages the collar and fastens the base plate to the door. The locking tongue has a transverse hole. A second element is an eyebolt with a looped head that is mounted into the side of the door jamb so that the looped head is in alignment with the transverse hole in the locking tongue for receiving a padlock therethrough. Other modifications include a two-piece eyebolt or an eyebolt of L-shaped configuration.

7 Claims, 6 Drawing Figures

28
24
26
26
39
18
38
12
56
82
80
14
30
32
86
84
40
36
52
54
50
44
34
90
100
88
58
88
92

36
40
46
54
52
14
58
100
104
90
102
34
88
44
60
84
98
92
62

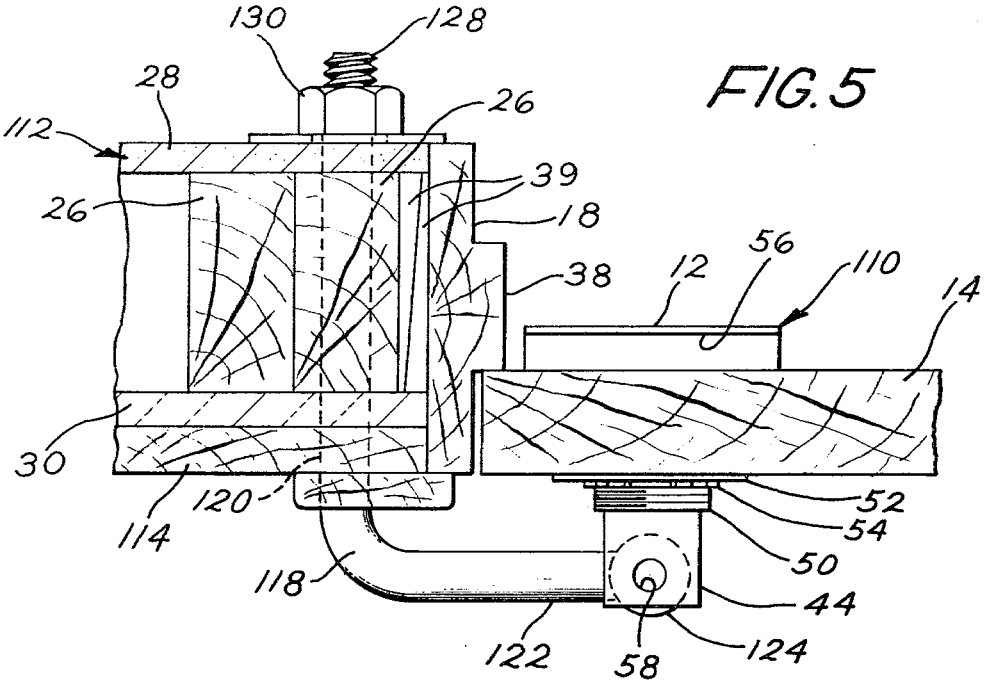
FIG. 5
FIG. 6
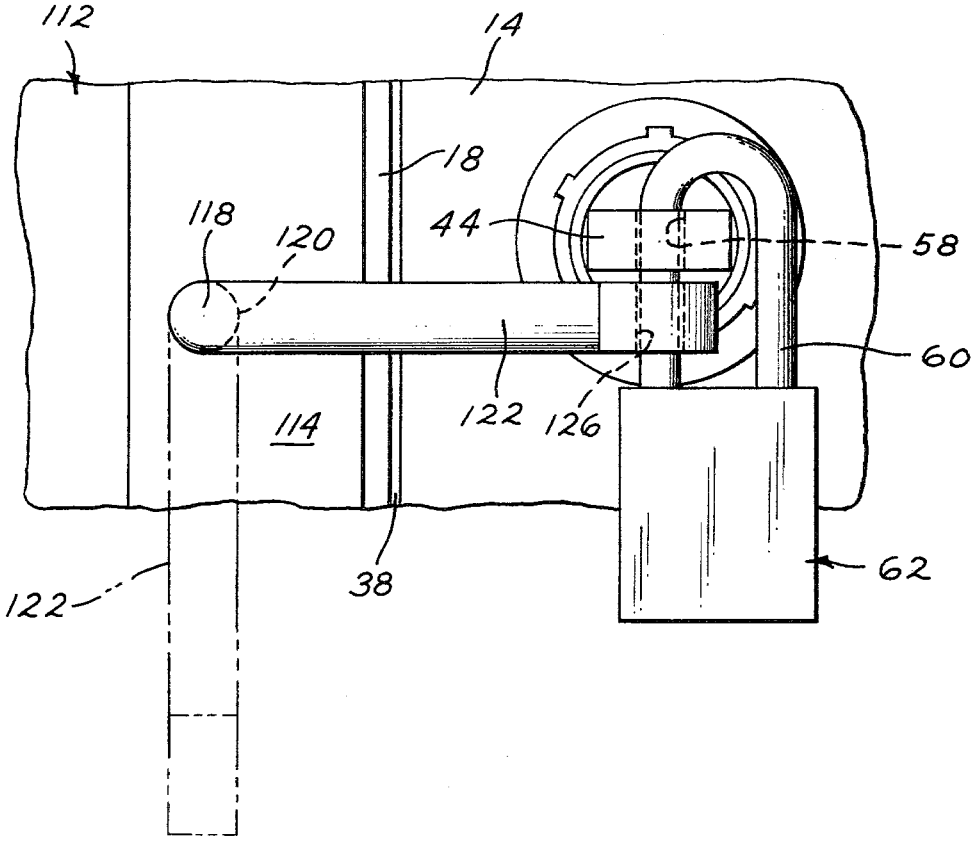

HEAVY DUTY SECURITY LOCK

BACKGROUND OF THE INVENTION

1. Field of the Invention

This invention relates to a security lock for making a quick-fix of a strong, impenetrable padlocked door locking system to replace a standard door lock which can be broken into by a professional burgler or locksmith. This invention is particularly useful to discourage vandalism in storage buildings or abandoned houses without defacing the door or the door jamb.

2. Description of the Prior Art

One common type of door lock employs a turn handle on both the outer and inner side of the door where the key is inserted into the face of the handle for operating the lock mechanism. Usually the edge of the door employs a pair of push buttons for either engaging or disabling the locking mechanism at will. The door jamb would include a metal keeper plate for receiving the locking tongue of the locking mechanism. Such turn handles may be fitted through a cylindrical hole through the door having a diameter of about $2\frac{1}{8}$ inches.

Another common locking mechanism for a door such as the front door of a house has a fixed handle with a movable thumb operated lever and a separate cylinder lock which is fitted through the door and frequently has a small turn handle on the inside of the door for enabling the door to be locked from the inside.

The Scott U.S. Pat. Ser. No. 716,118 shows a security lock for the swinging door of an outdoor showcase where the door frame is fitted with a fixed flat plate and the swinging edge of the door is fitted with a doubled-over plate so that the two plates telescope with each other when the door is in its vertical closed position.

The Buggeln U.S. Pat. No. 1,336,505 shows a hinged door and a pair of substantially L-shaped brackets. One bracket is secured to the door jamb and the other is secured to the door for receiving a padlock to prevent the door from being opened by an unauthorized person.

The Olson U.S. Pat. No. 1,554,592 discloses a form of hasp designed for boxes or cabinets, such a mechanics' toolboxes, where there is a lid which overhangs the front wall of the box.

The Mangus U.S. Pat. No. 2,698,196 relates to a door fastener where the door is a sliding door having a horizontal sliding movement. The door jamb is furnished with a Z-shaped bracket. The leading edge of the sliding door is provided with an L-shaped bracket for mating engagement with the Z-shaped bracket.

OBJECTS OF THE PRESENT INVENTION

A principal object of the present invention is to provide a security lock that is capable of replacing a standard key lock in a door so as to substitute a strong impenetrable padlocked door locking system for the standard locking mechanism.

A further object of the present invention is to provide a hasp type locking means as a replacement for a standard door key locking mechanism without doing permanent damage to the door or door jamb.

A further object of the present invention is to provide a heavy duty security lock of clearly visible massive proportions so as to discourage any would-be burgler from attempting to destroy the locking action of the mechanism.

A further object of the present invention is to provide a heavy duty security lock that may be mounted through the door lock mounting openings of a standard locking system without having to change the character of the door.

SUMMARY OF THE INVENTION

The present invention provides a heavy duty security lock for holding a movable closure or door to a fixed enclosure or door jamb. The lock has a base plate with a perpendicular locking tongue fitted with a shortened collar that is adapted to be mounted within a through hole in the door. An adjustable locking means engages the collar for fastening the base plate to the door. There is also an eyebolt with a looped head that is adapted to be mounted to the door jamb with the looped head in alignment with the transverse hole in the locking tongue for receiving a padlock therethrough.

BRIEF DESCRIPTION OF THE DRAWINGS

This invention will be better understood from the following description taken in conjunction with the accompanying drawings and its scope will be pointed out in the appended claims.

FIG. 5 is of a third modification of the present invention, and it is a fragmentary cross-sectional plan view taken just above the eyebolt where the eyebolt is of L-shaped configuration having a first shank portion and a second right-angular portion with a looped head for alignment with the transverse hole of the locking tongue.

FIG. 6 is a fragmentary front-elevational view of the third modification of FIG. 5 shows the right-angular portion of the L-shaped eyebolt in its full length locking position as well as in its open dotted-line vertical position which is free of interference with the door so that it may swing forwardly into its open position.

DESCRIPTION OF THE PREFERRED EMBODIMENTS

Figure 1:
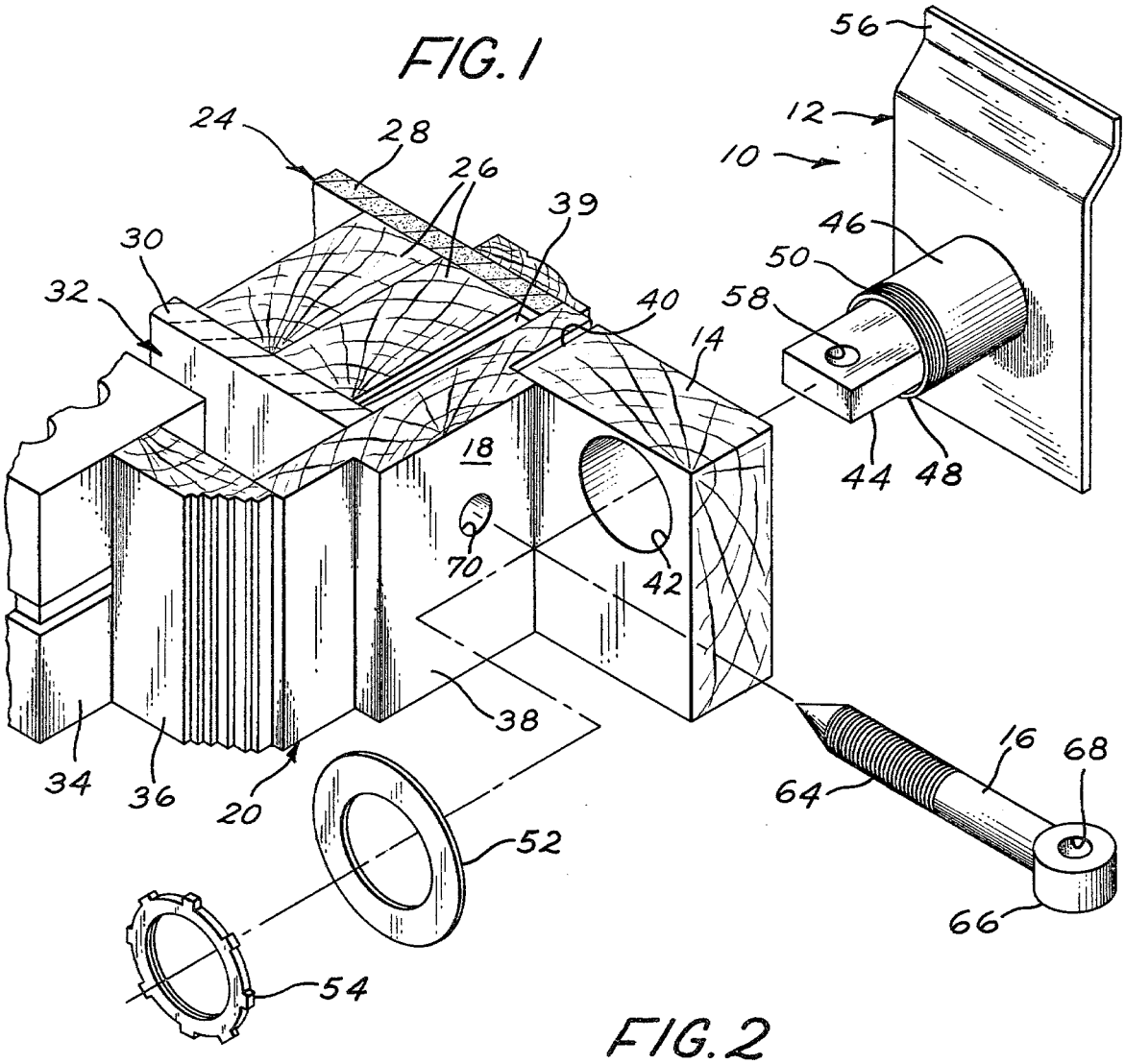
FIG. 1 is a fragmentary perspective view partly in cross section showing the details of construction of a residence with a brick veneer wall having a door opening that is framed by a door jamb and showing the door in its closed position and the various parts of the security lock in an exploded view.

Turning now to a consideration of the drawings and, in particular, to the fragmentary perspective view of FIG. 1, there is shown a security lock 10 embodying the present invention. This lock 10 has two main elements; namely, a base plate 12 that is mounted to the door 14 or other movable closure, and an eyebolt 16 that is adapted to be mounted in the vertical side face 18 of the door jamb 20 which forms a fixed enclosure for the door 14.

First a little description will be given of a typical door framing of a house or other structure for use with the security lock 10 of the present invention.

A vertical wall 24 has vertical studs 26 to which are mounted on the inside dry wall paneling 28, and on the outside insulation board 30. Usually there is a dead air space 32 between the insulation board 30 and an outer brick veneer 34. When the wall is to be provided with a door opening, the studs are spaced the proper distance and the door jamb 18 is framed around the sides and the top of the door opening. A brick molding 36 is fitted between the brick veneer 34 and the front edge of the door jamb 18. Of course, there are other types of construction that could be used to form a vertical wall of a house or other structure. Notice that the central portion of the door jamb 18 is thickened, and this area is known as the door slam stop 38.

The present invention of security lock 10 was originally conceived as a quick-fix replacement of a strong, impenetrable padlocked door locking system to replace a standard door lock in empty or abandoned houses or remote storage buildings or the like. Accordingly, this invention will be described in such a context, but of course it will be understood by those skilled in the home construction industry that this invention could also be used for new construction or other temporary use in order to avoid the expense of security guards, night watchmen, and the like.

Figure 2:
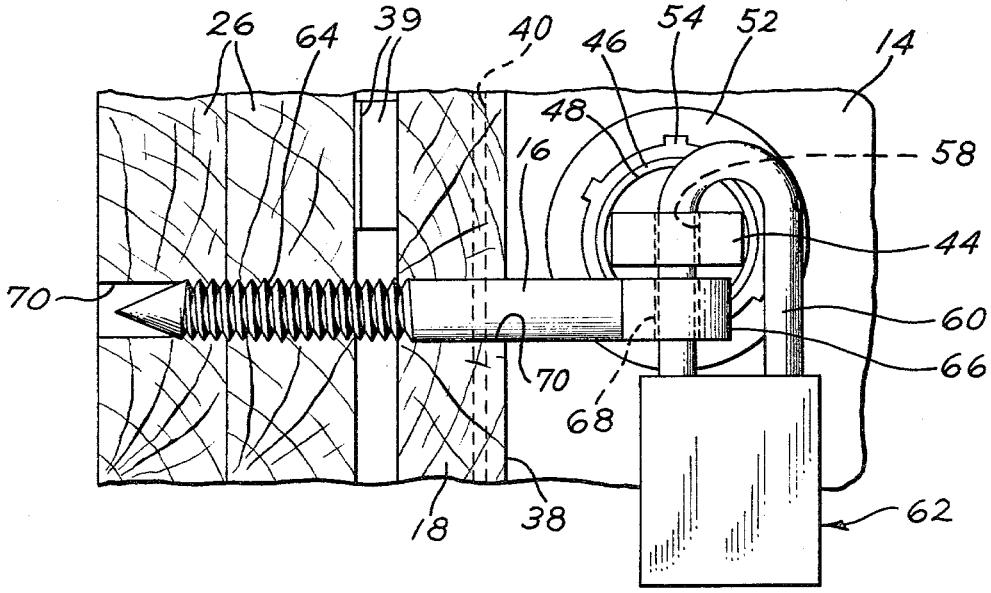
FIG. 2 is a fragmentary cross-sectional elevational view taken through the longitudinal axis of the eyebolt and showing the door in its closed position and a padlock locking the door closed.

The door 14 is depicted as a movable closure; for example, as a swinging door having a free vertical side 40. Near this free vertical side 40 is formed a cylindrical hole 42 that is of standard size to receive a cylinder lock; for example, 2⅛ inches or the like. This hole 42 is positioned rather close to the free vertical side 40 and at about waist height. The base plate 12 of the security lock 10 is a thin, flat, metal plate of heavy gauge sheet steel. Near the center of this plate is welded a rectangular bar 44, which serves as a locking tongue. One end of this bar or locking tongue is welded to the flat plate 12 so that the tongue is positioned perpendicular to the plate and horizontal with relation to the door. A short cylindrical collar 46 is slipped over the locking tongue, and it may either be welded to the flat plate 12, or to the bar 44, or both. The objective is that the plate 12, the bar 44, and the collar 46 are all fixed with relation to each other. The locking tongue 44 and collar 46 are adapted to slip into or through the lock opening 42 from the inside of the door 14. The length of the collar 46 is slightly greater than the thickness of the door 14 so that the free edge 48 of the collar protrudes forwardly of the front face of the door 14. This free edge 48 is threaded at 50 for a sufficient length to receive a plain washer 52 and a threaded lock ring 54. Thus, it will be understood that in order to mount the base plate 12 to the door 14, it is first necessary to reach around to the inside of the door 14 and insert the locking tongue 44 and its collar 46 through the hole 42 until the plate 12 engages the inner surface of the door, and then to hold the plate until the washer 52 and the lock ring 54 can be assembled onto the collar 46 and the ring tightened until the ring 54 cannot be tightened further. Notice that the tip of the locking tongue 44 is provided with a vertical transverse hole 58 that is adapted to receive the shackle 60 of a padlock 62, as is best seen in FIG. 2. But it is not yet time to install the padlock 62 because the nature of the eyebolt 16 has not been fully explained yet.

The eyebolt 16 is a relatively large bolt that is threaded at one end 64, and it has a looped head 66 at the other end. This looped head 66 has a transverse hole 68. To install this eyebolt 16 into the slam stop 38 of the door jamb 18, it is first necessary to drill a hole 70 horizontally into the slam stop of the door jamb a sufficient length so that the eyebolt may be screwed into place until the transverse hole 68 of the looped head can be aligned with the transverse hole 58 of the locking tongue 44, as is best seen in FIG. 2. It will be appreciated by those skilled in this art that while the padlock 62 is in place, as shown in FIG. 2, it is impossible to remove either the eyebolt 16 or the base plate 12 and locking tongue 44. Hence, the door 14 or other movable closure is permanently attached to the door enclosure or door jamb 18. Moreover, this security lock 10 is such that it does not injure the appearance surfaces of the door or door jamb. It is true that the hole 70 in the door jamb is an additional element, but once this security lock 10 is removed it is very easy to fill the hole 70 and restore the appearance of the face of the door jamb so that it is not blemished or otherwise seriously damaged. Element 56 is a handgrip means, and 39 are shims.

Figure 3:
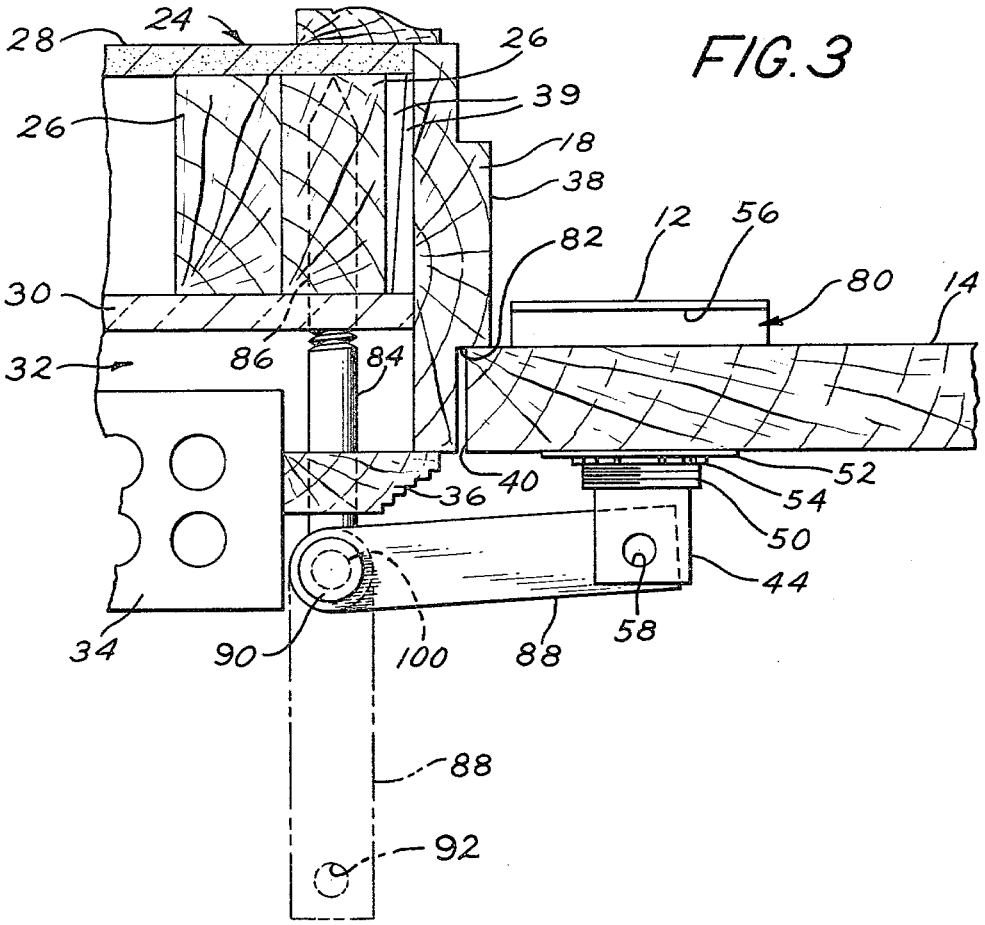
FIG. 3 is a fragmentary cross-sectional plan view taken on a plane just above the eyebolt of a second modification of security lock of the present invention, where the eyebolt is a two-part device having a first threaded portion and a second swinging portion.

FIG. 3 is a fragmentary cross-sectional plan view of a second modification of the present invention taken on a plane just above the security lock 80. Many of the same elements of FIGS. 1 and 2 are illustrated in FIG. 3, and when there is no change in the element, they will be given the same reference number in FIG. 3 as in FIGS. 1 and 2. The wall structure 24 is the same as is shown in FIG. 1; therefore, the elements of the wall are given the same reference numerals as in FIG. 1. Moreover, the flat plate 12, locking tongue 44, and collar 46 are the same as in the first modification.

Figure 4:
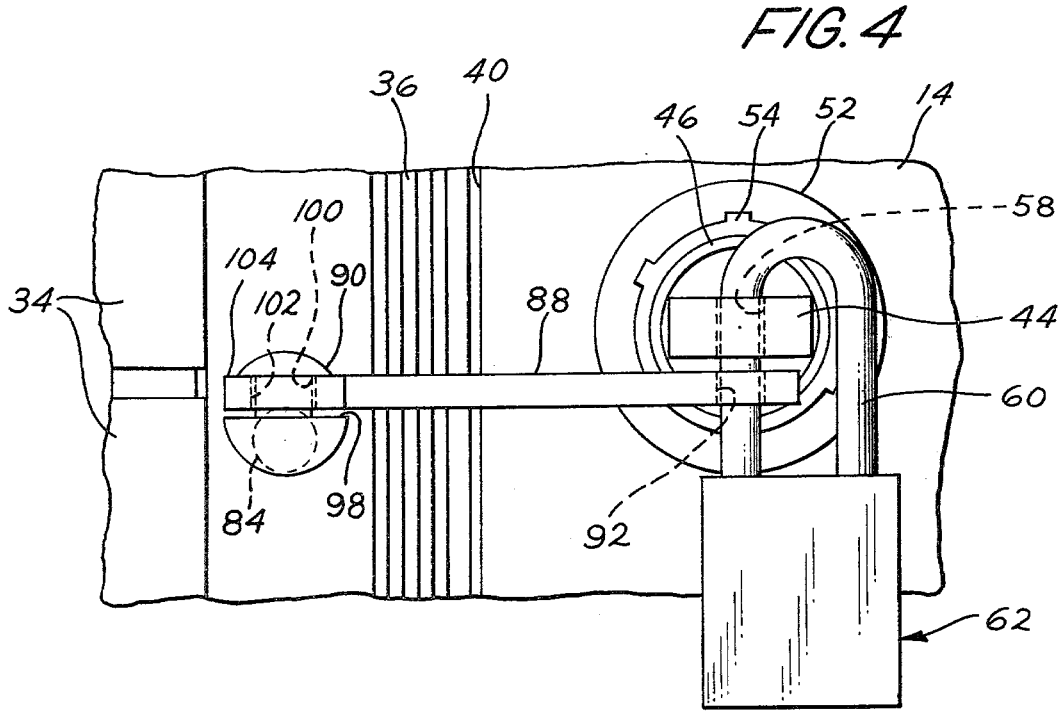
FIG. 4 is a fragmentary front elevational view of the second modification of security lock, as shown in FIG. 3, showing the padlock joining the locking tongue of the base plate with the swinging portion of the two-piece eyebolt.

The main difference in this second modification 80 of FIG. 3 is that the eyebolt is to be attached directly into the brick molding 36 that is perpendicular to the vertical wall 24, rather than perpendicular into the door jamb 18. The main reason for this is that the door 14 of FIG. 3 opens to the outside of the building, that is it swings to the outside, and it engages the front side 82 of the door slam stop 38. Such an arrangement would be present in a public building where it is necessary for the door to open outwardly for fire regulation purposes, while the inwardly swinging door of FIG. 1 is more standard in private residences and the like. Since the door 14 of FIG. 3 is on the front side of the door slam stop 38, the best place to install the new eyebolt 84 is directly into the front of the brick molding 36, as is illustrated. The main feature of this eyebolt 84 is that it is a two-piece member having a first threaded portion 86 for engagement into one of the vertical studs 26 and a second swinging portion 86 which is pivotally attached to the first portion by means of a permanent rivet 90 or the like. The free end of the second swinging portion 88 has a through hole 92 that is for alignment with the transverse vertical hole 58 of the locking tongue 44 for receiving the shackle 60 of the padlock 62 therethrough. As seen in the plan view of FIG. 3, the eyebolt 84 has a generally L-shaped configuration in its locking position with the locking tongue 44. However, this L-shaped configuration cannot be a rigid configuration because of the interference with the eyebolt 84 of the brick veneer 34. It is not possible to turn the eyebolt 84 through 360 degrees as it is being screwed into the vertical stud 26 because the second portion 88 would strike the brick veneer 34. This interference can be overcome by rendering the second portion 88 of the eyebolt 84 a swinging member so that it turns through an angle of only 180 degrees, and then is it swung to the opposite side of the eyebolt, and then turned another 180 degrees and then swung to the opposite side of the eyebolt, and turned another 180 degrees until the eyebolt is in its proper position so that the through hole 92 is accurately aligned with the vertical hole 58 of the locking tongue 44. Notice in FIG. 4, which is a fragmentary front elevational view of FIG. 3, that the first threaded portion 86 of the eyebolt 84 has on its outermost end a semi-spherical formation 96 which is generally flat on its top side, as at 98, and it includes a cylindrical shank 100 which is adapted to slip into a hole 102 of the pivoted end 104 of the second swinging portion 88 of the eyebolt 84. Then the topmost portion of the shank 100 is flattened out in the manner of a rivet head so as to permanently attach the seond swinging portion 88 to the first threaded portion 86 of the eyebolt 84.

A third modification 110 of the security lock of the present invention is illustrated in FIGS. 5 and 6. Again, the same elements of the earlier figures that are shown in FIGS. 5 and 6 without change will be given the same reference numerals in order to simplify the description of this third modification. Here the door 14 again swings outwardly into its open position, but the vertical wall 112 that cooperates with the door is of more simple construction. Notice there is no brick veneer. This construction is more of a commercial or low-cost residential construction having dry wall paneling 28 on the inside, vertical studs 26, insulation board 30 that is covered with wood siding 114 on the outside, and the door opening is finished by a door jamb 18 with a door slam stop 38. Notice the pair of shims 39 for adjusting the position of the door jamb 18, as is conventional in this art.

Again, the flat base plate 12 is the same as in the first modification of FIGS. 1 and 2. The same is true of the collar 46, the locking tongue 44, and the washer 52, and lock ring 54.

This modification also has a new eyebolt 118, and it is of rigid L-shaped configuration having a first shank portion 120 for engagement with the fixed enclosure of the door and a second right-angular portion 122 that has at its free end a looped head 124 with a transverse hole 126 for alignment with the vertical hole 58 in the locking tongue 44 for receiving the shackle 60 of the padlock 62. One reason that this eyebolt 118 is of rigid L-shaped configuration is that it is used with a vertical wall 112 that has a flat front face so that it is possible to turn the eyebolt about the longitudinal axis of the first shank portion 120 without interference from any part of the wall structure. Another feature of this eyebolt 118 is that it is loosely mounted in the wall 112 by the fact that it is held to the wall by cooperation of its threaded end 128 that receives a nut 130 that is assembled from the inside of the wall 112. Thus, in order to allow the swinging door 14 to open outwardly, it is first necessary to pivot the second right-angular portion 122 of the eyebolt 118, either up or down an angle of about 90 degrees, as is shown in dotted lines in FIG. 6, so as to be out of the way of the door when it does swing open or close.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A security lock for holding a movable closure to a fixed enclosure comprising:

a. base plate means having a perpendicular locking tongue fitted with a shortened collar that is adapted for mounting within a through hole in the closure;

b. adjustable locking means adapted for engaging the collar and fastening the base plate means to the said movable closure;

c. a transverse hole near the tip of the tongue;

d. and an eyebolt with a looped head adapted to be mounted in the said fixed enclosure with the looped head in close alignment with the transverse hole in the locking tongue for receiving a common locking means therethrough.

2. The invention as recited in claim 1 wherein the said collar is formed integral with the locking tongue and the base plate means, the front portion of the collar being threaded and the said adjustable locking means being a threaded ring member for locking engagement on the collar for holding the locking tongue in a position protruding from the closure.

3. The invention as recited in claim 1 wherein the said base plate means is a thin plate member with one edge portion turned inwardly to form a hand grip means for use from the inner side of the door.

4. The invention as recited in claims 1 or 2 wherein the base plate means is a thin plate member, the locking tongue is an elongated rectangular bar that is welded on its end in a horizontal position to the front face of the plate member, and wherein the said collar is only slightly longer than the thickness of the closure.

5. The invention as recited in claims 1 or 2 wherein the said eyebolt is a threaded bolt which is screwed into the fixed enclosure, and the looped head of the bolt closely parallels the tip of the locking tongue.

6. The invention as recited in claims 1 or 2 wherein the said eyebolt is a two-piece member having a first threaded portion for engagement with the fixed enclosure, and a second swinging portion which is pivotally connected to the first portion, the free end of the second portion having a through hole for alignment with the transverse hole of the locking tongue for both receiving the said common locking means therethrough.

7. The invention as recited in claims 1 or 2 wherein the said eyebolt is of L-shaped configuration having a first shank portion for engagement with the fixed enclosure and a second right angular portion with a looped head adjacent the free end for alignment with the transverse hole of the said locking tongue, said right angular portion also being adjustable between a first locking position overlying the closure and a second retracted position away from the closure.

* * * * *